US011988413B2

(12) United States Patent
Braathen

(10) Patent No.: US 11,988,413 B2
(45) Date of Patent: May 21, 2024

(54) WATER HEATER

(71) Applicant: Thor Frölich Braathen, Eggedal (NO)

(72) Inventor: Thor Frölich Braathen, Eggedal (NO)

( * ) Notice: Subject to any disclaimer, the term of this patent is extended or adjusted under 35 U.S.C. 154(b) by 0 days.

(21) Appl. No.: 17/995,944

(22) PCT Filed: Apr. 30, 2020

(86) PCT No.: PCT/NO2020/050112

§ 371 (c)(1),
(2) Date: Oct. 11, 2022

(87) PCT Pub. No.: WO2021/221512

PCT Pub. Date: Nov. 4, 2021

(65) Prior Publication Data

US 2023/0184462 A1 Jun. 15, 2023

(51) Int. Cl.
*F24H 1/18* (2022.01)
*F24H 9/02* (2006.01)

(52) U.S. Cl.
CPC ..... *F24H 9/02* (2013.01)

(58) Field of Classification Search
CPC . F24H 1/182; F24H 9/02; F24H 1/181; F24H 1/18; F17C 1/12
See application file for complete search history.

(56) References Cited

U.S. PATENT DOCUMENTS 5,923,819 A 7/1999 Ross et al.
6,143,217 A * 11/2000 Jackson ..... F24H 1/182 29/455.1
7,699,026 B2 * 4/2010 Gordon ..... F24H 1/182 122/494
9,194,606 B2 * 11/2015 Braathen ..... F24H 9/17
10,288,312 B2 * 5/2019 Richardson ..... F24H 1/182
10,890,357 B2 * 1/2021 Hutchison ..... F24H 1/182
2012/0067301 A1 3/2012 Braathen
2013/0043252 A1 2/2013 Nelson
2022/0196287 A1 * 6/2022 Porwal ..... F24H 9/02
2022/0404065 A1 * 12/2022 Barendrecht ..... F24H 9/1818

FOREIGN PATENT DOCUMENTS

AU 2014201694 A1 10/2014
DE 29712325 U1 9/1997
DE 102012105017 A1 12/2013
(Continued)

OTHER PUBLICATIONS

Bråten, Knut; International Search Report; PCT/NO2020/050112; dated Nov. 17, 2020; 3 pages.

*Primary Examiner* — Gregory A Wilson
(74) *Attorney, Agent, or Firm* — Bradley Arant Boult Cummings LLP

(57) ABSTRACT

A water heater includes a tank, an insulation blanket, and an outer shell. The insulation blanket includes a preformed foam assembled from at least two pieces of foam, which together surround the tank. The outer shell includes a lower part surrounding the at least two pieces of foam. The at least two pieces of foam have notches extending along outer comers thereof to form channels between the pieces of foam and the lower part. The channels extend from above the tank to a drain outlet from the lower part to conduct any leakage out of the water heater.

7 Claims, 4 Drawing Sheets

(56) References Cited

FOREIGN PATENT DOCUMENTS

| | | | | |
|---|---|---|---|---|
| EP | 1571404 | A1 | | 9/2005 |
| JP | 2009180488 | A | | 8/2009 |
| JP | 2015140953 | A | | 8/2015 |
| JP | 6420577 | B2 | * | 11/2018 |
| WO | WO-0053981 | A1 | | 9/2000 |
| WO | WO-2010137987 | A2 | | 12/2010 |

* cited by examiner

WATER HEATER

TECHNICAL FIELD

The present invention relates to a water heater. In particular, the invention relates to a water heater with improved insulation against heat loss.

BACKGROUND ART

Today it is state of the art that a water heater comprises a stainless-steel tank, generally consisting of a top dome, a bottom dome and a cylindrical centre piece extending between the domes. These parts are welded together. Outside of the tank is an insulation blanket and an outer shell. The insulation blanket is commonly made of spray foam that has been sprayed in between the stainless-steel tank and the outer shell.

This construction works very well as long as the water heater works without any failure. However, if the tank or any of the couplings to the tank starts to leak, it is impossible to locate the leak without having to cut apart the shell and the insulation blanket. Also, the leak may have been present for quite some time before it is detected. In the meantime, water may have leaked out from the water heater unnoticed and caused great damage. As a consequence, the water heater is often discarded without even attempting to fix it.

This is not environmentally friendly, and it causes unnecessary costs for the owner.

There exist water heaters attempting to remove or at least ease some of the above disadvantages.

JP2015140953A shows a tank that is to be placed inside two substantially equal insulation halves that cover the centre piece and the lower dome. The insulation halves join along a vertical plane. At the top there is a separate insulation piece. All these parts are placed inside an outer shell. The outer shell has no separate cover at the top, but the top insulation piece also forms a top cover. Inside the insulation halves there is made room for valves and connections. There is no means to handle leakage.

EP 1571404A1 shows storage tank having an insulation consisting of two virtually identical insulation halves and two virtually identical outer shell halves. The halves join along a vertical plane and are either coupled by a snap connection or glued together. There is no space for valves and couplings that can be opened to check for leaks. Moreover, there is no means to handle any leakage.

DE 29712325 U1 shows a water heater having two virtually identical insulation halves. The halves could join either along a vertical or a horizontal plane. The halves are joined around the tank and then the assembled insulation halves with the tank inside are eased into an outer shell from the top thereof. If the joining of the halves is along the horizontal plane, the heater can be mounted by first inserting the bottom insulation tank into the shell, then the tank and then the upper insulation half. The outer shell is closed off by a top lid. There is no easily accessible space for valves and couplings and no means to handle any leakage.

US 20130043252 describes a water heater having a heat pump, which is placed in a cover that is formed in two halves. Each half has insulation inside. The water tank below the cover also has insulation arranged in two parts, but this is not described in any detail.

The cover has a space for installations, such as valves and couplings, as well as an evaporator, compressor, a control unit etc. A drip shield is arranged to lead water away from the heating element of the water heater during maintenance but will not have any function if a leak occurs elsewhere in the water heater.

Other prior art examples are shown in DE 102012105017 and AU 201401694.

SUMMARY OF INVENTION

The purpose of the present invention is to provide a water heater which is safe against unnoticed water leaks. This is achieved by the features given in the characterizing clause of claim 1.

The water heater should fit within the de facto standard of a 600 mm width and depth footprint. This facilitates placing the water heater in a space, such as in a cupboard, a space adapted for washing machine, dishwasher etc.

Despite being designed to lead water leaks safely away from the insulation, the water heater has at least the same insulation properties as the best insulated heaters on the market today. It is also easy to produce and repair, as well as disassembling at the end of the life cycle, so that the materials can be 100% recycled.

The design also means that the water heater is easy to transport without being susceptible to damage.

Valves and couplings as well as any pumps, expansion vessels etc. are enclosed in an insulated space within the water heater. The space is easily accessible for inspection and repair. All pipes are nevertheless hidden from view, even if two or more water heaters are connected in series. This means that any heat loss from pipes is greatly reduced.

As for conventional water heaters, the tank volumes should be 100, 200 or 300 litres, according to need for capacity. If 200 litres heaters are connected in series, they can provide a capacity of 200, 400, 600 or 800 litres. If 300 litres heaters are connected in series, they can provide a capacity of 300, 600, 900 or 1200 litres.

As the heater has a footprint within 600×600 mm, it can easily be transported through a standard door opening of 800×2100 mm.

A water heater includes a tank, an insulation blanket and an outer shell. The insulation blanket includes a preformed foam assembled from at least two pieces of foam and together surrounding the tank. The outer shell includes a lower part surrounding the at least two pieces of foam. The at least two pieces of foam have notches extending along outer corners of the at least two pieces of foam to form channels between the at least two pieces of foam and the lower part of the outer shell. The channels extend from above the tank to a drain outlet from the lower part to conduct any leakage out of the water heater.

The outer shell may be a plastic blow mould that has been manufactured according to the following steps: 1) blow moulding the outer shell as one unitary piece, the unitary piece having a section of smaller outer diameter near the top thereof, the smaller outer diameter corresponding with an inside diameter of the unitary piece below the section of smaller outer diameter; 2) cutting the unitary piece in two at a transition between the smaller outer diameter section and the unitary piece below the section of smaller diameter, to create an upper shell part having a lower edge with the smaller outer diameter and a lower shell part having an upper edge with an inside diameter corresponding with the smaller outside diameter; 3) inserting a piece of foam insulation into the upper shell part, the piece of foam insulation being retained by a transition between a larger inside diameter and a smaller inside diameter crated by the section of smaller outside diameter; 4) mating the upper shell part with the lower shell part until the upper edge of the lower shell part meets a transition between the smaller outer diameter and a larger diameter of the upper shell part, the transition and the upper edge forming a water-tight seal.

DETAILED DESCRIPTION OF THE INVENTION

Figures 1, 4A:
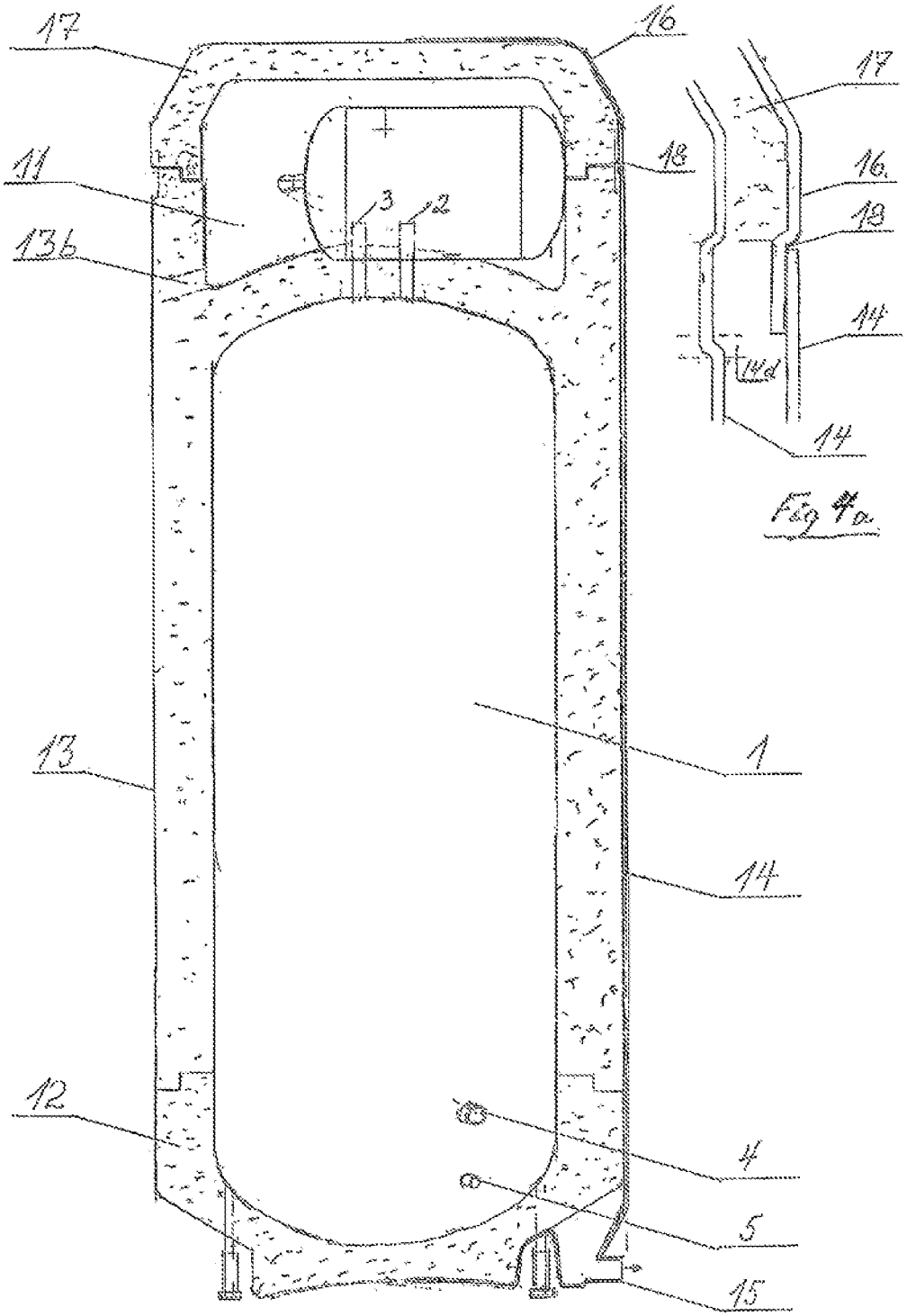
FIG. 1 shows a longitudinal cross section through the water heater of the invention.
FIG. 4*a* shows a detail at the transition between the lower outer shell and the top cover, illustrating the manufacture and assembly of the outer shell of the water heater.

FIG. 1 shows a water heater with a tank 1 having a top-mounted connection 2 for cold water into the tank 1 and a top-mounted connection 3 for hot water out of the tank 1. The tank 1 also has a connection 4 for an electric heating element and a connection 5 for draining of the tank 1.

Outside of the tank 1 is an insulation blanket. The insulation blanket is made up of a plurality of preformed foam pieces, as will be explained in further detail below.

A first piece of insulation is a lower part 12. This has a preformed space 6 forming a compartment for electric couplings, see FIG. 2*b*.

Above the lower part 12 is a middle part 13 that constitutes a second piece of insulation. This part 13 extends from the lower part 12 to above the top of the tank 1. At the top of the middle part 13 is formed a space 11 into which the connections 2, 3 for cold and hot water extend. In this space 11 there is room for valves and couplings, as well as any expansion vessel, pump, circulation loop, heat pump etc. The height of the space 11 can be adapted to the required space for this equipment.

The third piece of insulation is a top part 17, which is placed on top of the middle part 13 to close off the space 11.

Outside of the insulation is an outer shell, which comprises a lower shell part 14 that extends all around the lower part 12 and middle part 13 of the insulation, and an upper shell part 16 that extends around the top insulation part 17. The top insulation part 17 and the upper shell part 16 constitutes a top cover.

The mounting of the parts of the water heater is as follows:

First the tank 1 is mounted with its lower end into the lower insulation part 12, then the middle insulation part 13 is threaded over the upper end of the tank 1 and pushed onto the tank 1 until it meets the lower insulation part 12. The thus assembled parts 1, 12, 13 can then be pushed into the lower shell part 14 until the lower insulation part 12 reaches the bottom thereof.

Finally, the upper insulation part 17 and the upper shell part 16 are mounted on top of the thus assembled parts 13, 14. As shown in FIG. 4*a*, the top shell part 16 overlaps the bottom shell part 14, preferably on the inside thereof, in an area 18. This provides a sturdy fit, but it is nevertheless easy to remove the top part 16 with the insulation part 17 for inspection or maintenance.

Figure 2:
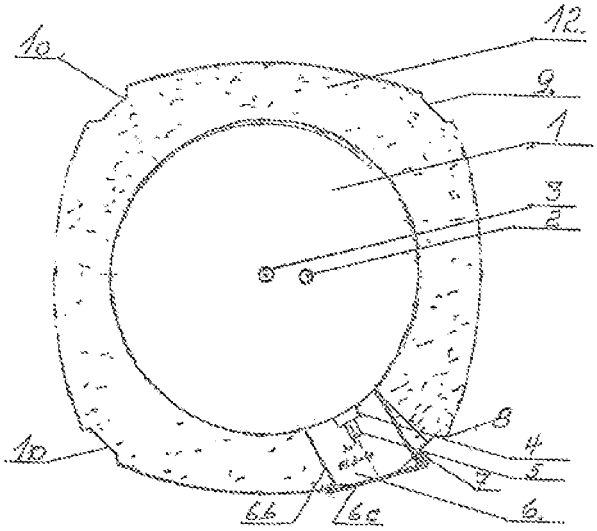
FIG. 2 shows a cross section through a lower part of the water heater of the invention.

FIG. 2 shows the lower insulation part 12 seen from above. It is shown as having a generally square outer shape, i.e. with rounded sides. The outer shapes of the lower part 12 and the middle part 13 are generally the same (see the FIG. 3 for the cross-section of the middle part 13). At each corner of parts 12 and 13 there is a notch 8, 9, 10. These notches 8, 9, 10 extend along the whole height of the parts 12, 13, and forms channels 8*a*, 9*a*, 10*a* (see FIG. 3) between the insulation parts 12, 13 and the lower part 14 of the outer shell.

The lower part 12 also has a recess 6 formed in one side thereof. This recess extends all the way through the thickness of the part 12, from the outside facing the shell 14 to the inside facing the tank 1. This recess provides space for the part of the heating element 4 extending from the tank 1, as well as electrical wires, thermostat etc. and the drain 5. The outer shell 14 has an opening generally flush with the recess 6. This opening in the outer shell 14 can be closed with a lid 6*c*.

The tank 1 is oriented within the insulation and the outer shell so that the heating element 4 and the drain 5 are situated in a part of the insulation where the insulation is at its thickest, but not overlapping the corner thereof. This provides a deeper recess and hence more space for electrical connections. A suitable orientation of the heating element 4 and the drain 5 is about 30 degrees away from the thinnest part of the insulation, which is at the middle of the curved side of the water heater. This also means that the recess 6 is next to and is in communication with the notch 8, so that the electric wires can extend between the notch and the recess 6.

Within the recess 6 is arranged a frame 6*b* of non-flammable material. The frame 6*b* lines the insulation foam and prevents any heat that may occur due to, e.g., a short-circuit, from reaching the insulation foam.

If the drain 5 is opened to empty the tank 1, the water will run from the drain 5 into the notch 8 and to the bottom of the outer shell 14. As shown in FIG. 1, the outer shell 14 has an end piece 15 that is open to the outside. Hence, water that runs into the bottom of the shell 14 will drain to the outside and can be led to a floor drain in the room where the heater is placed.

The notch 8 also has a function as a path for electric wires 7 extending from the space 11 at the top of the heater to the recess 6. The wires connect to the heating element 4 and thermostat.

Figure 2B:
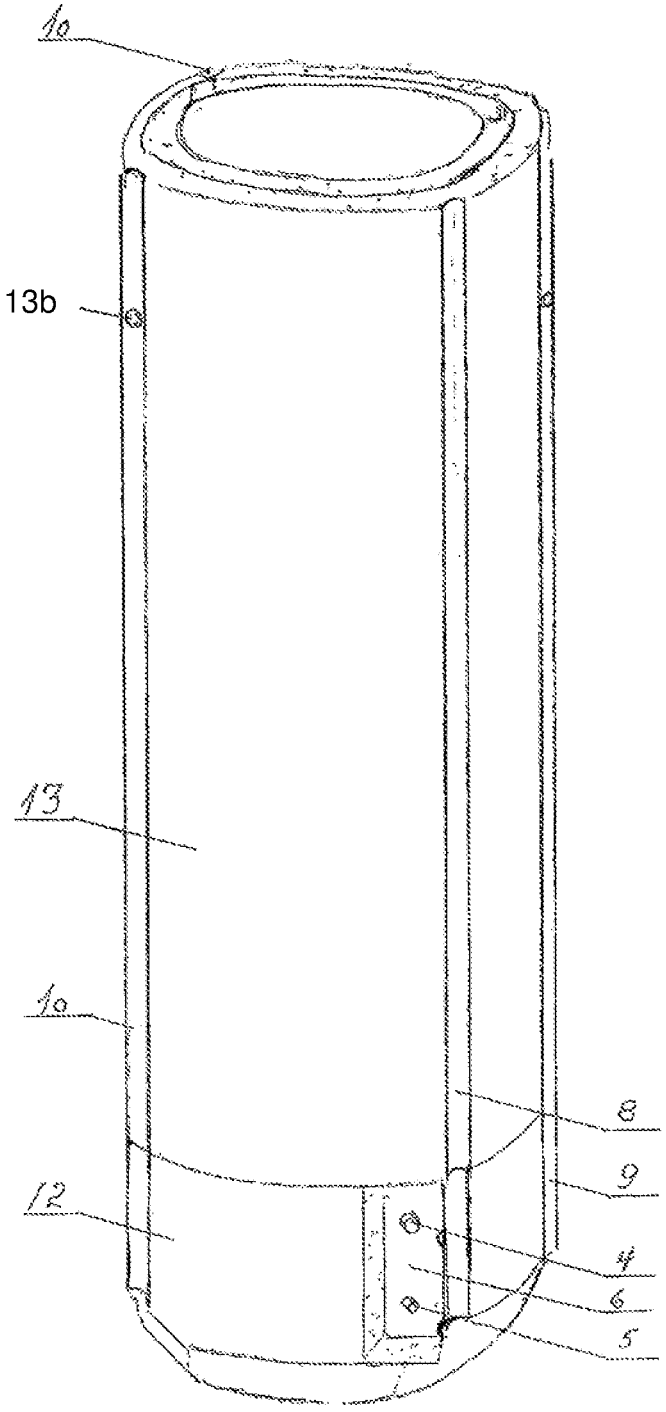
FIG. 2*b* shows an isometric view of the water heater without the top cover and the outer shell.

FIG. 2*b* shows the lower insulation part 12 and the middle insulation part 13 in assembled state. It shows that the recess 6, providing space for the heating element 4, drain 5 and electrical wires etc., is delimited by the lower insulation part 12 on three sides (bottom, left and right) and the middle insulation part 13 on one side (top). FIG. 2*b* also shows three of the notches 8, 9 and 10, extending along the full length of the insulation parts 12, 13.

Figure 3:
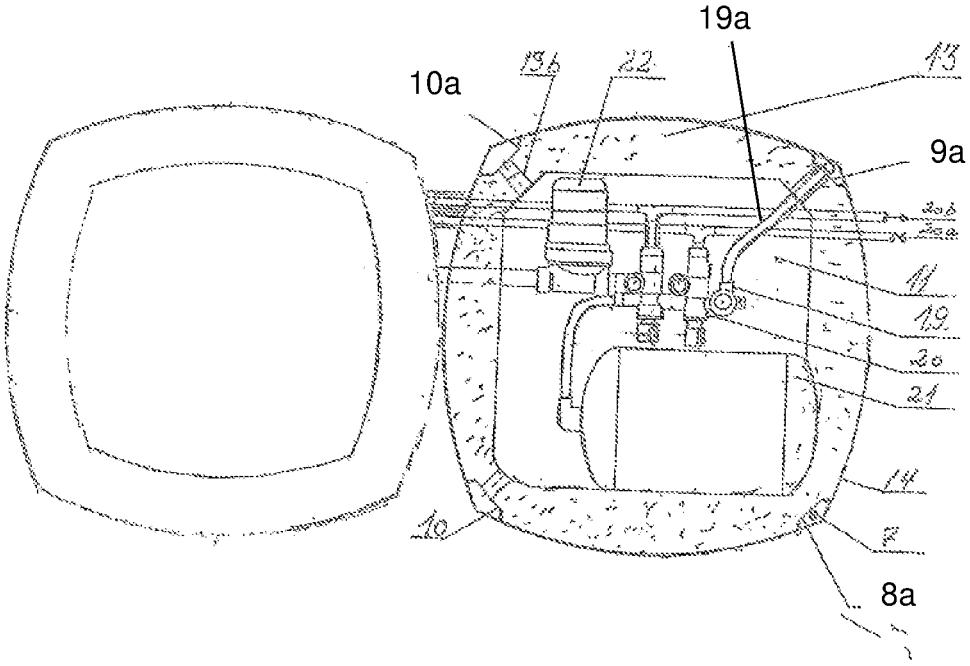
FIG. 3 shows a cross section through an upper part of the water heater of the invention, as well as a second water heater next to the first water heater.

FIG. 3 shows the middle insulation part 13 from above. It also shows the space 11 within which various equipment commonly used in a water heater are arranged, such as a mixing valve 20 with a safety valve 19, expansion vessel 21 and circulation pump 22.

The mixing valve 20 is coupled to the cold-water connection 2 and the hot water connection 3 of the tank. A cold-water pipe 20*a* extends into the water heater to supply cold-water and a hot-water pipe 20*b* extends out of the water heater to supply hot-water to various tap points in the building.

From the safety valve 19 an overflow pipe 19*a* extends through the insulation to the notch 9*a*. Hence, any water released by the safety valve 19 will flow to the notch 9 and downwards to the bottom of the outer shell 14 and from there out of the draining end piece 15.

FIG. 3 also shows the electrical wires 7 extending along the notch 8 to the recess 6.

The two remaining notches 10 are connected to the space 11 by a channel 13*b* through the insulation. Hence any water leaking from the equipment in the space 11 will flow to the notches 10, down to the bottom of the outer shell and out the draining end piece 15.

FIG. 3 shows a second water heater arranged besides the first water heater.

Pipes for hot and cold water 20*a*, 20*b* extend the short distance from the first to the second water. These pipes are almost invisible from the outside. This way it is possible to connect two (or more) water heaters in series. As the pipes are situated practically within the insulation, the heat loss is minimal.

It is also easy to change one of the heaters if needed.

As stated above it is possible to achieve a wide range of total water heater volume by serial production of only three water heater sizes, such as 100, 200 and 300 litres.

Figure 4:
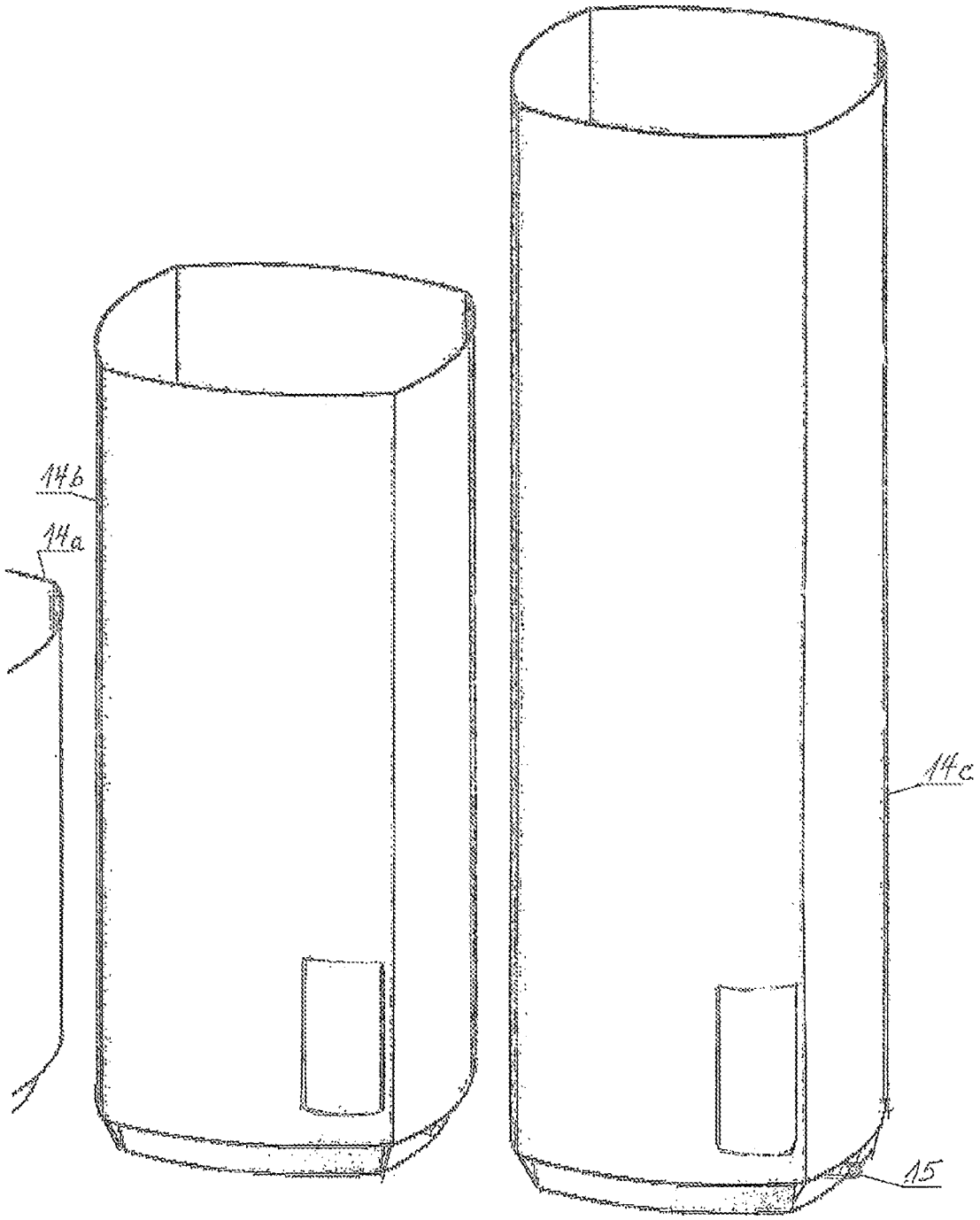
FIG. 4 shows outer shells of the water heater in three different heights.

FIG. 4 shows 3 different sized outer shells 14*a*, 14*b*, 14*c*, for 100, 200 and 300 litre tanks, respectively. The first shell 14*a* is shown only partially. The top cover is not show. The draining end piece 15 is shown in the shell 14*c*, but all shells have such an end piece.

As is clear from FIG. 4, the only difference between the three shells 14*a*, 14*b* and 14*c* is the height.

FIG. 4 shows a detail at the joint between the lower shell part 14 and the upper shell part 16 to illustrate the production of the two parts. As shown to the left in FIG. 4*a*, the two shell parts 16, 14 are formed in one piece, such as by blow casting. A section of the one-piece shell has a smaller diameter. The smaller diameter differs from the rest of the shell by two times the thickness of the shell. After the forming, the shell is cut in two at the lower transition between the larger diameter and the smaller diameter, as illustrated by the lines 14*d*. This creates a cover having a diameter at its lower edge, which will fit inside the lower outer shell, as illustrated in the right part of FIG. 4*a*. At the point denoted by 18, the edge of the lower shell part 14 will form a tight fit with the cover 16. This fit is watertight for all practical purposes. The top insulation part 17 will be held in place by butting against the smaller diameter of the upper shell part 16 at the point 18.

The invention claimed is:

1. A water heater comprising:

a tank, an insulation blanket;

an outer shell;

the insulation blanket comprising a preformed foam assembled from at least two pieces of foam and together surrounding the tank; and the outer shell comprising a lower part surrounding the at least two pieces of foam, wherein the at least two pieces of foam having notches extending along outer corners of the at least two pieces of foam to form channels between the at least two pieces of foam and the lower part of the outer shell, the channels extending from above the tank to a drain outlet from the lower part to conduct any leakage out of the water heater.

2. The water heater of claim 1, wherein one of the pieces of foam extends above the tank to form a space on top of the tank, the space accommodating technical equipment, such as connections to the tank, piping, mixing valve, safety valve, expansion vessel, pump, and that the space is connected to at least one of the channels running along the foam pieces to allow leakage water inside the space to flow to the bottom of the lower part of the outer shell.

3. The water heater of claim 1 wherein a recess is formed on at least one of the foam pieces, the recess extending from the lower part of the outer shell to the outer wall of the tank, the recess accommodating the part of a heating element extending from the tank as well as a drain for emptying the tank, the lower part of the outer shell having an opening corresponding with the recess.

4. The water heater of claim 3, wherein at least one of the channels accommodates electrical wires extending between the space above the tank and the recess.

5. The water heater of claim 3, wherein the insulation blanket and outer shell has an approximately square cross section, that the tank is oriented within the insulation blanket so that the heating element and drain are facing the thickest portion of the insulation blanket, and that the recess is arranged in an area extending from a corner of the insulation blanket, such that the heating element and drain are oriented about 30 degrees away from the thinnest portion of the insulation blanket.

6. The water heater of claim 1, wherein the outer shell is a plastic blow mould that has been manufactured according to the following steps:

blow moulding the outer shell as one unitary piece, the unitary piece having a section of smaller outer diameter near the top thereof, the smaller outer diameter corresponding with an inside diameter of the unitary piece below the section of smaller outer diameter, cutting the unitary piece in two at a transition between the smaller outer diameter section and the unitary piece below the section of smaller diameter, to create an upper shell part having a lower edge with the smaller outer diameter and a lower shell part having an upper edge with an inside diameter corresponding with the smaller outside diameter, inserting a piece of foam insulation into the upper shell part, the piece of foam insulation being retained by a transition between a larger inside diameter and a smaller inside diameter crated by the section of smaller outside diameter, mating the upper shell part with the lower shell part until the upper edge of the lower shell part meets a transition between the smaller outer diameter and a larger diameter of the upper shell part, the transition and the upper edge forming a water-tight seal.

7. The water heater of claim 1, wherein pipes for hot and colds water extend through the insulation foam and the outer shell from the space on top of the tank, the pipes extending to a second water heater arranged next to the first water heater.

* * * * *